United States Patent [19]

Jageler et al.

[11] 4,396,074

[45] Aug. 2, 1983

[54] DRILL BIT EXTENSION FOR SIDEWALL CORER

[75] Inventors: Alfred H. Jageler; Lauren G. Kilmer; Houston B. Mount, II; George W. Terral, all of Tulsa, Okla.

[73] Assignee: Standard Oil Company (Indiana), Chicago, Ill.

[21] Appl. No.: 321,655

[22] Filed: Nov. 16, 1981

[51] Int. Cl.[3] ..... E21B 25/02; E21B 49/06

[52] U.S. Cl. ..... 175/78; 175/58; 175/61

[58] Field of Search ..... 175/52, 61, 77, 78, 175/79, 80, 81, 82, 83, 20; 166/240

[56] References Cited

U.S. PATENT DOCUMENTS 2,354,399 7/1944 Noble ..... 175/77

2,456,331 12/1948 Sewell ..... 175/77

2,599,405 6/1952 Mennecier ..... 175/78

3,107,740 10/1963 Cante ..... 175/78

*Primary Examiner*—Ernest R. Purser

*Assistant Examiner*—Joseph Falk

*Attorney, Agent, or Firm*—John D. Gassett

[57] ABSTRACT

This invention relates to an apparatus for cutting cores from the sidewall of a borehole after the borehole has been drilled. The apparatus includes an elongated housing which supports guide means which provides a path along which a core bit and motor can be moved to extend and retract the core bit. The guide means has a rotational control section and a transverse control section. The rotation control section guides the motor and its core bit from an upright position in the housing to a selected angle and the vertical transverse control section guides the coring bit means in the direction of the formation.

8 Claims, 11 Drawing Figures

DRILL BIT EXTENSION FOR SIDEWALL CORER

BACKGROUND OF THE INVENTION

This invention relates to sidewall cores. In determining the physical properties of subterranean formations it is of great assistance to have what is commonly called cores. A core is typically a cylindrical piece of the rock which has been cut from the underground formation and can vary in size and length. A typical size is ½ inch diameter and 4 to 6 inches long; although samples can be of larger diameter and of greater length, depending upon the facilities available. One type of core cutter is the type that can be used to cut the cores from the sidewall of a borehole after the borehole has already been drilled. Such a sidewall coring tool is described in U.S. Pat. No. 4,280,569, issued July 28, 1981, to Houston B. Mount, II, inventor, and Standard Oil Company (Indiana), assignee. This invention relates to such a sidewall coring tool.

BRIEF DESCRIPTION OF THE INVENTION

This invention relates to an apparatus for use in cutting a sidewall core in a borehole drilled in the earth; this includes an elongated frame which supports a guide means along which the drill bit and motor can be moved to extend and retract the cutting bit and core barrel along a selected path. The guide means has a rotation control section and a transverse control section. The rotation control section causes the motor and its core barrel to move from an upright position to an angle with the vertical and transverse guide section guiding the coring bit means against the formation. The guide means includes a fixed guide plate supported by the frame and having an interconnected guide slot system including an inner arcuate section and outer arcuate section having a common center and a straight section intersecting one end of each of said inner and outer arcuate sections. The guide slot system is arranged to receive first and second guide pins which are attached to the motor. One guide pin fits into one of the arcuate sections and the other into the other arcuate section, and as the motor is forced along the elongated support frame, the guide means causes the motor to rotate to a selected angle with respect to the guide frame until it reaches a straight slot section where continued force on the motor causes it to proceed outwardly from the center of the guide frame against the sidewall of the hole. At this point the motor which carries the core bit and the core barrel is actuated, and as the bit drills into the sidewall, continued force applied on the motor causes the motor to travel on the straight line and cause the bit to cut a hole and corresponding core from the sidewall. When the core cutter bit has reached a preselected extension, the second guide pin is forced into a break notch in the straight slot section, thus forcing the motor and the rear end of the core barrel to move in a direction essentially perpendicular to its axis, and thus breaks the core from the formation. By reversing the direction of the force on the motor, the motor, core barrel and core bit are retrieved into the elongated frame.

A better understanding of the invention may be had from the following description taken in conjunction with the drawings.

DETAILED DESCRIPTION

Figure 1:
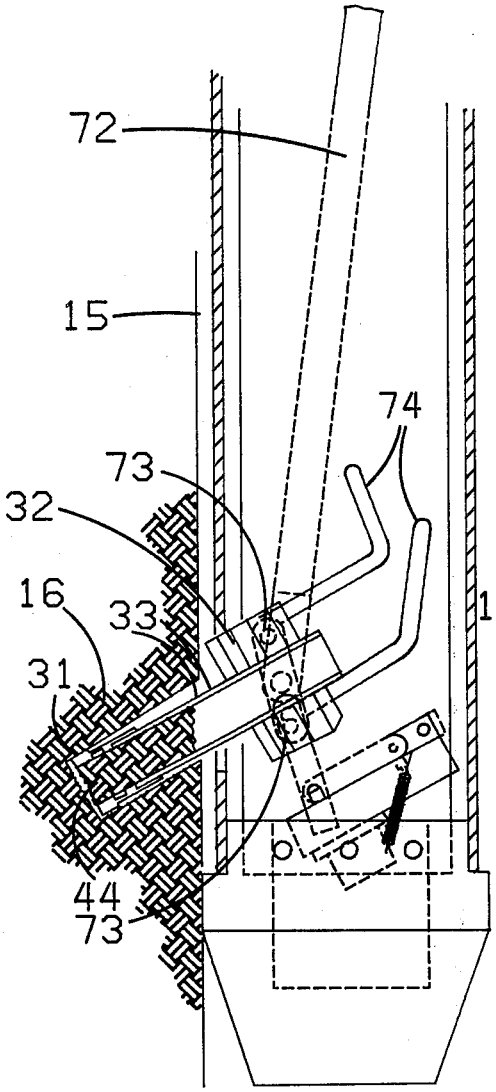
FIG. 1 is a schematic view depicting a core cutting means in the core break position.
Figure 2:
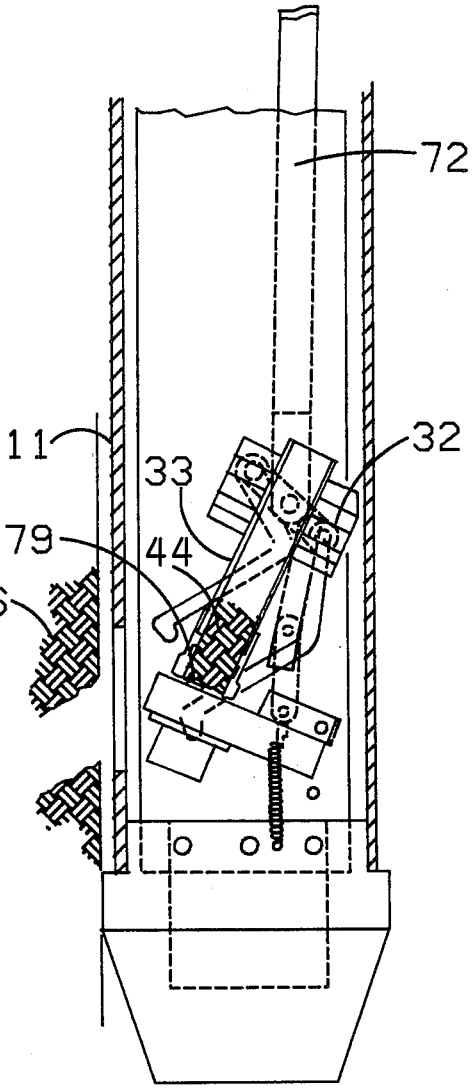
FIG. 2 is a schematic view depicting the core cutting means of FIG. 1 in a retracted position with a retained core.

FIGS. 1 and 2 show an embodiment described in said U.S. Pat. No. 4,280,569, and is shown herein to illustrate the setting of the present invention. FIG. 1 shows a core cutting device in a borehole drilled in formation 16 and having a core cutting head 31 connected to hydraulic motor 32 for rotation about the longitudinal axis of a core retaining barrel 33. The hydraulic motor 32 is connected to connecting arms 72 through guide pin 73 to a motor, not shown, for moving the core cutting head 31 through an opening in housing 11 and into cutting engagement with a sidewall of a drillhole 15. It is shown in FIG. 1 that the guide pins 73 which are attached to the hydraulic motor 32 had advanced to the ends of the guide slot 74 which had been expanded to provide for the deflection of the core barrel 33 within the hole drilled by the core cutting head 31. FIG. 2 illustrates the retracted position of the core cutting means 31, 33 and core 44 to its resting position within the housing 11. For more details of the structure and operations of the tools shown in FIGS. 1 and 2, references are made herein to said U.S. Pat. No. 4,280,569.

Figure 3:
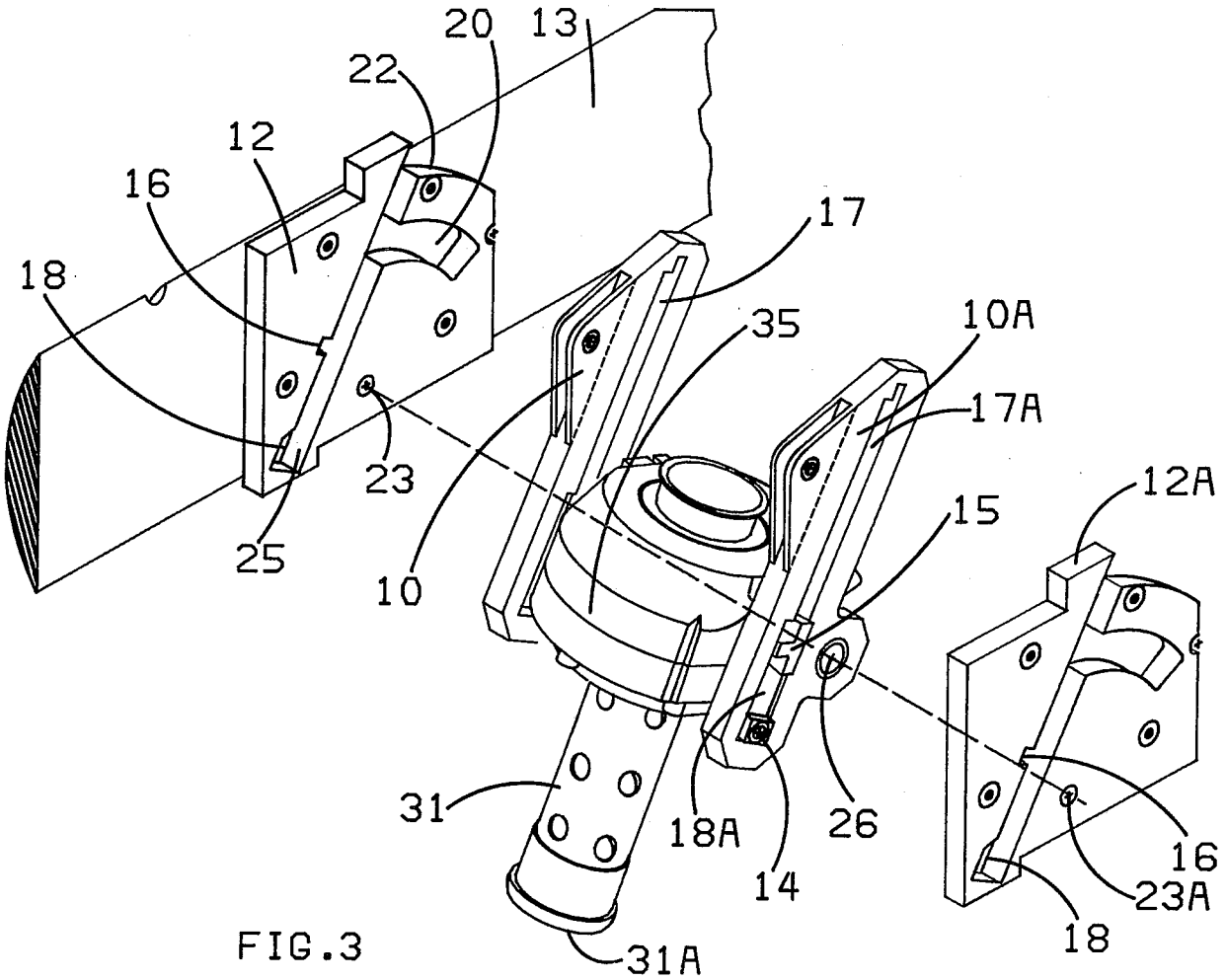
FIG. 3 is an exploded isometric view showing a fixed guide plate, a rotating guide plate, and the motor.

Reference is next made to FIG. 3 which is an exploded view illustrating a new and improved guidance system for the motor, core barreling and core cutter bit. It includes oppositely mounted rotating plates 10 and 10A and fixed plates 12 and 12A. Plate 12 is mounted to frame 13 which is mounted to and secured to the main frame of the overall tool such as housing 11 of FIG. 2. Opposite fixed plate 12A is similarly supported from a frame not shown but comparable to frame 13. Fixed guide plate 12 is provided with an interconnected guide slot system including an inner arcuate section 20 and an outer arcuate section 22 which each has a common center at pivot 23. The guide slot system has a traverse or straight section 25 which intersects arcuate sections 20 and 22. Transverse section 25 has a break notch 16 and a clearance slot 18. The functions of these will be described later. Plate 12 can be made an integral part of frame 13, but is preferably made separately so that it can be replaced as necessary.

The rotating guide plate 10 is provided with a longitudinal slot 17 having a clearance slot 18A in one end. Plate 10 is free to rotate about a pivot point 26. When the system is assembled, the axis of pivot point 26 lies on the line of the axis of pivots 23 and 23A. A hydraulic motor 35 having a core cutting bit 31A and core retaining barrel 31 is shown. Various types of motor 35 can be used. Motor 35 is provided with two guide pins on each side, such as 14 and 15. One set of guide pins are indicated in FIG. 3 as rear guide pin 15 and forward guide pin 14. When assembled, one set of guide pins 14 and 15 on motor 35 extend through slot 17A of rotating plate 10A and into the guide slot system of fixed plate 12A. A second set of guide pins (not shown but similar to pins 14 and 15) on motor 35 extends through slot 17 of rotating plate 10 and into the guide slot system of fixed plate 12. The assembly is held in position by frame 11 by any practical mechanical system such as screws.

Figure 6:
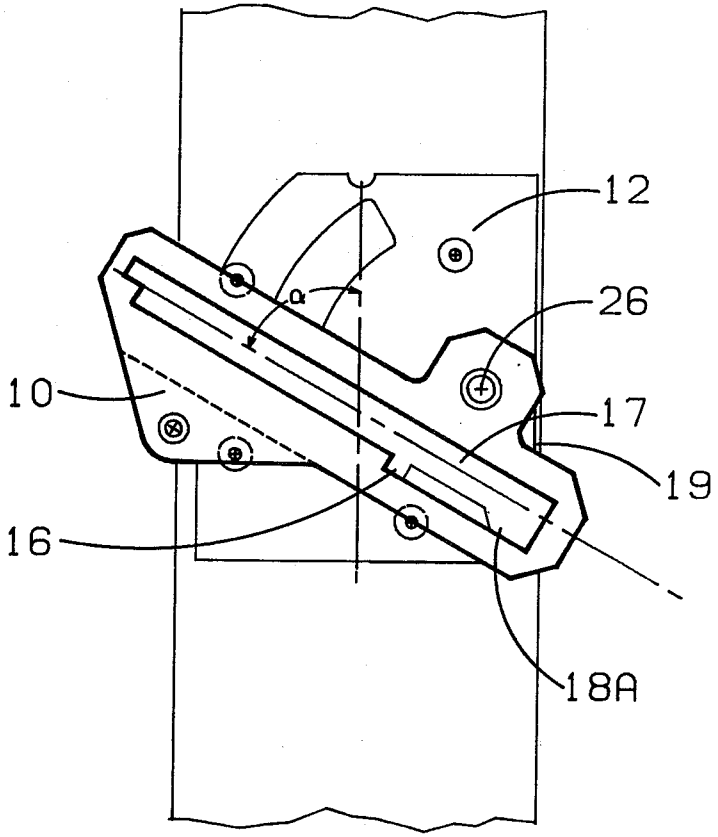
FIG. 6 is similar to FIG. 5 except an outline of the rotating plate has been imposed thereon.
Figure 5:
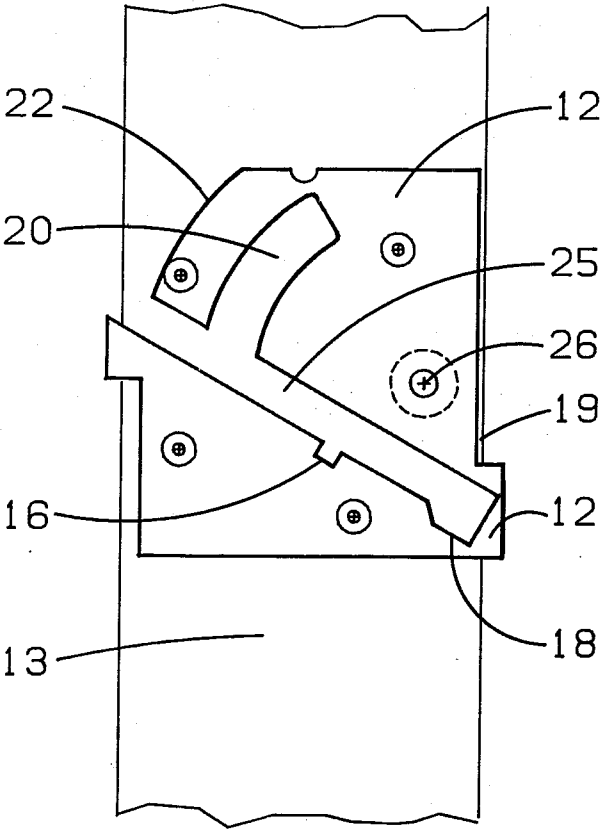
FIG. 5 is a schematic view of the fixed guide plate.
Figure 7:
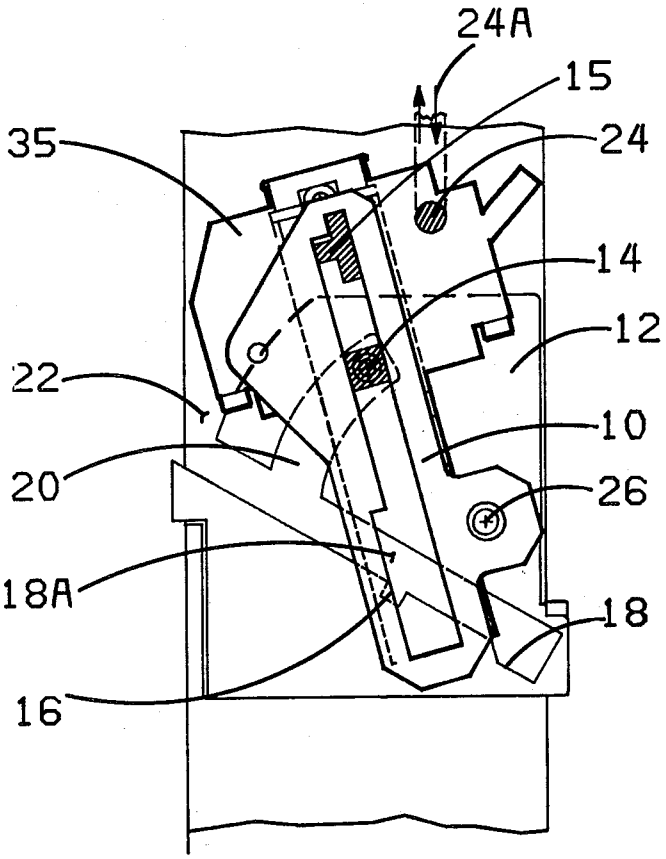
FIG. 7 is a schematic view showing the outline of the fixed guide plate, the rotating guide plate, the motor and the guide pins of the motor in the completely retracted position.

Attention is briefly directed to FIG. 5 which shows a fixed plate 12 mounted on frame 13 and which shows an opening 19 in the housing through which the core cutting bit 31A and core retainer 31 may extend. Attention is next directed to FIG. 6 which shows schematically the overlay of rotating plate 10 which has a slot 17 with clearance section 18A which extends from the break notch 16 to the clearance slot 18 of fixed plate 12. FIG. 7 has the outline of motor 35 and pins 14 and 15 added thereto. The guide pins 15 and 14 of motor 35 are held firmly in place through slot 17 of rotating plate 10 and into the guide slot system of fixed plate 12. A force is applied to motor 35 through contact point or drive pin 24. This force can be either in an upward or downward direction as indicated by the arrows 24A that are shown in FIG. 7. The force is applied through drive pin 24 such that a straight line indicating its direction does not intersect pivot 26. This is to assure a rotating motion about pivot 26 when force is applied to drive pin 24.

Figure 4:
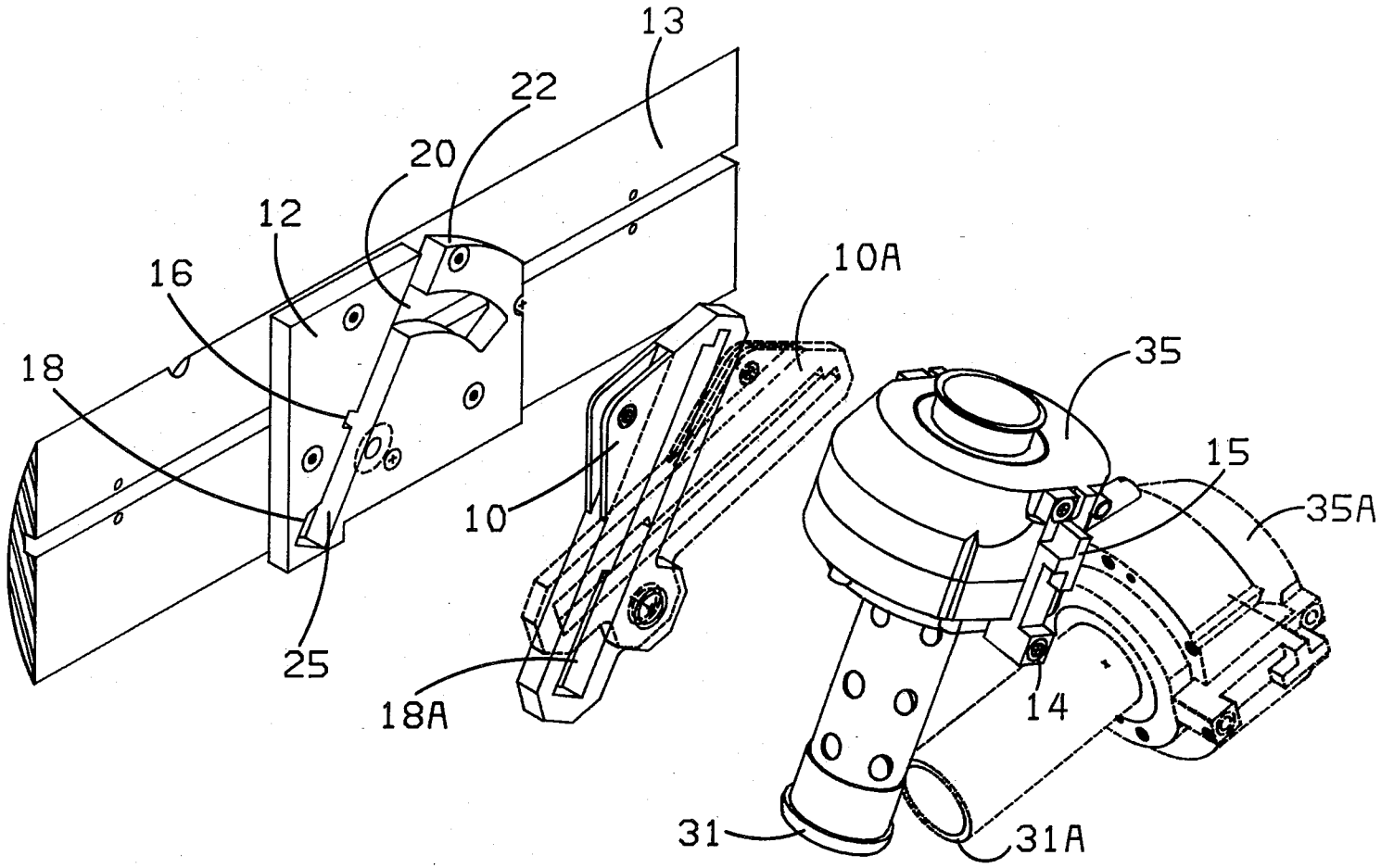
FIG. 4 is similar to FIG. 3 except the rotated position of the rotating plate and the motor is indicated in dashed lines and only one rotating plate and one fixed plate are shown.
Figure 8:
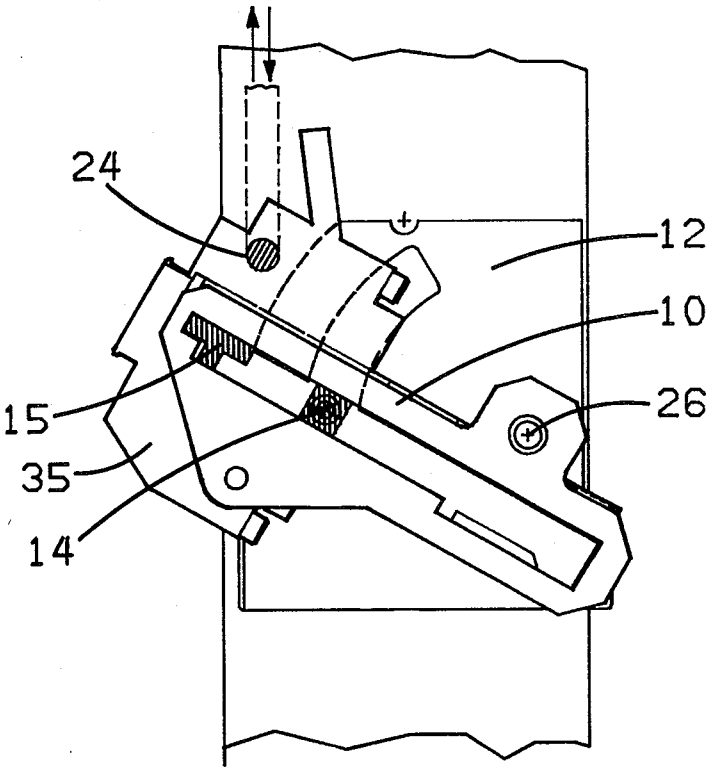
FIG. 8 is similar to FIG. 7 except the guide pins are in a different position with respect to the fixed guide plate showing the rotation of the motor.
Figure 11:
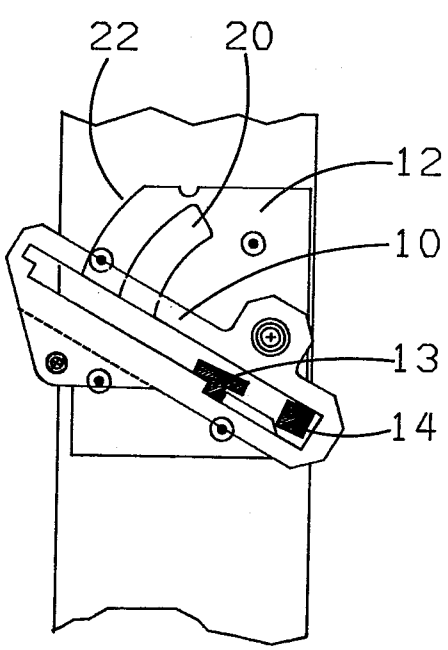
FIGS. 9, 10 and 11 are similar to FIG. 6 except that the two guide pins of the motor which fit into the slots so the fixed guide plates are shown thereon to indicate various positions and functions.
Figure 10:
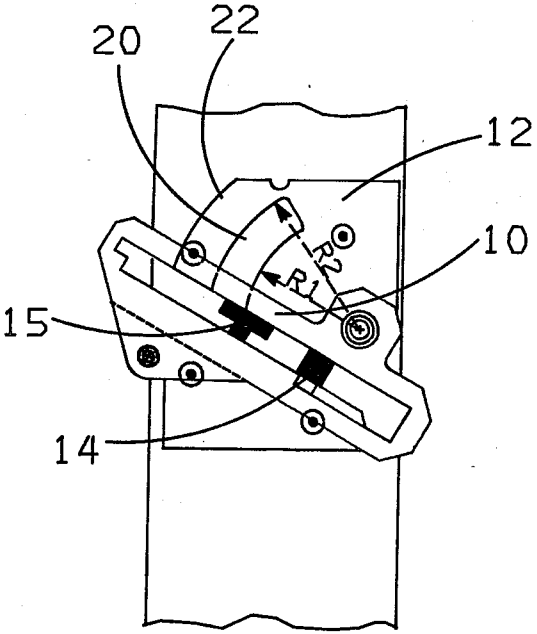
Figure 9:
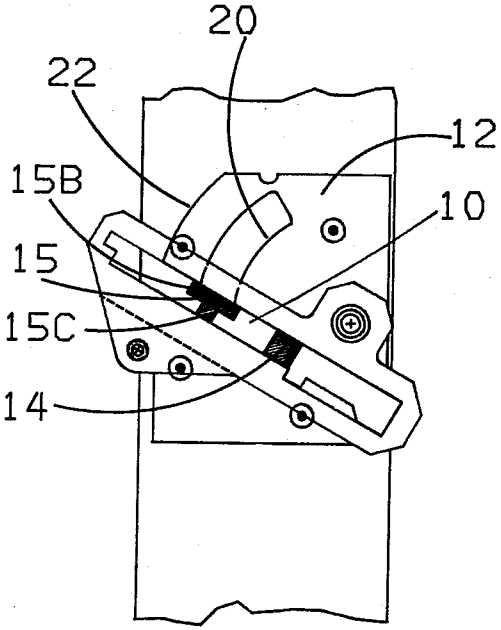

Attention is now directed to FIG. 8 to show an intermediate position of motor 35. There we can see that the motor pins 14 and 15 have cleared arcuate sections, 20 and 22 (FIG. 7) and are in the traverse section or slot 25 (FIG. 5). It can be seen then that the motor and accompanying coring bit have rotated to where they are aligned along the slot 25. This position of motor 35 is indicated by the solid line of motor 35 in FIG. 4; the dashed outline shows the retracted position. The angle $\alpha$ shown is at about 30°. The angle $\alpha$ is indicated in FIG. 6 and is the angle between the longitudinal axis of slot 25 and housing 11. It has been found that an angle $\alpha$ of about 45° is probably the preferred angle for minimum frictional force between the guide pins and slot 25. It can be seen in FIG. 8 that the rotating plate 10 has rotated about pivot 26 and, in effect, has driven the motor about the same pivot axis as the center of arcuate sections 20 and 22. Further force on drive pin 24 will cause the guide pins 14 and 15 to move downwardly along slot 25. Further downward force on drive pin 24 will cause the motor and core bit to extend through the opening 19 in the wall and cause the bit to contact the side wall of the borehole. At this time, the motor 35 can be actuated and the core bit start operating. Details of the core cutting functions are described in said U.S. Pat. No. 4,280,569. A further movement position is indicated in FIG. 10 which shows pin 14 as being too long to enter break notch 16. The next sequence is shown in FIG. 11 which is the break position. Additional application of the force on drive pin 24 would cause the motor guide pins 14 and 15 to assume the position indicated in FIG. 9. It is believed that it is the appropriate time to describe the cross-sectional shape of the pins 14 and 15. Pin 14 is square in shape and has a side which is of greater dimension than the size of the opening of break notch 16. This is to prevent pin 14 from falling into notch 16 as indicated in FIG. 10. Pin 15 has a T configuration. Pin 15 is provided with an upper section 15B and a lower section 15C. The lower section 15C is such that it will fit into break slot 16. The upper end 15B has a greater length which is greater than the width of the mouth of inner arcuate guide 20.

Continued downward force on drive pin 24 causes the motor to travel along section 25 until pins 14 and 15 reach the position shown in FIG. 11. The rear guide pin 15 is in break notch 16 and forward guide pin 14 is in clearance slot 18. This is to permit the core barrel to shift slightly to break the core from the formation so that it can be retrieved.

To retract the motor and drill bit, a reverse force is applied to drive pin 24. In order for this to function properly, the drive pins 14 and 15 must enter slots 20 and 22, respectively. This is assured because pin 15 cannot enter into slot 20. Thus, continued upwardly force will cause the guide pins to assume their positions shown in FIG. 8 so that they can enter the correct arcuate positions. Pins 14 and 16 fit snugly in the slot 17 of rotating plate 10 and in transverse slot 25 of fixed plate 12 with there being a small clearance of, e.g., 3 thousandths of inch. In one embodiment built the typical width W of the slots 17 and 25 is about 0.375 inches. Typically R1 and R2 shown in FIG. 10 can be about 1.475 and about 2.460 inches, respectively. The length of slots 17 and 25 are about 4.730 and 4.500 inches, and slots 14 and 15 are about 1.120 inches apart.

The rotating plate 10 is primarily to maintain alignment of the motor with the relation to the rotating pin through the rotation sequence. Otherwise any moment which could be generated about the motor might lock the guide pins in the guide slot system.

While the above invention has been described in details, various modifications can be made thereto without departing from the spirit or scope of the invention.

What we claim is:

1. An apparatus for use in cutting a sidewall core in a borehole comprising:

a frame, a motor having a first guide pin and a second guide pin, a fixed guide plate supported by said frame and having an interconnected guide slot system including an inner arcuate section, an outer arcuate section having a common center with said inner arcuate section, and a straight section intersecting one end of each said inner and outer arcuate sections, said guide slot system arranged to receive said first and second guide pins.

2. An apparatus as defined in claim 1 including a rotating guide plate pivotably supported from the frame adjacent said fixed guide plate and having a longitudinal slot alignable with said straight section of said fixed plate at one rotational position of said rotating guide plate, said first and second guide pins extending therethrough.

3. An apparatus as described in claim 1 including means for applying an external force to said motor to move said motor along said guide slot system.

4. An apparatus as defined in claim 1 in which said straight section has a break notch in one side thereof which is opposite said arcuate slots.

5. An apparatus as defined in claim 4 in which said first guide pin is "T" shaped having a top section and a stem with the stem fitting into said break notch and said second guide pin having a width greater than the opening of said break notch so that it cannot enter therein.

6. An apparatus as defined in claim 5 in which said straight section of said fixed guide plate has a break notch on one side thereof, opposite the arcuate sections and a clearance slot on the same side as said break notch for receiving said second pin when said first pin enters said break notch.

7. An apparatus as defined in claim 5 in which the axis of rotation of said rotating plate is on a line perpendicular to the fixed guide plate and which intersects the center of said arcuate sections.

8. An apparatus as defined in claim 7 in which the width of said top section is greater than the width of said inner arcuate slot and the width of said second stem is less than the width of said inner arcuate section.

* * * * *